US007402057B1

(12) United States Patent
Strang et al.

(10) Patent No.: US 7,402,057 B1
(45) Date of Patent: Jul. 22, 2008

(54) ENHANCED SHORTING CLIP

(75) Inventors: William G. Strang, Warren, OH (US); Adam M. Kemp, Boardman, OH (US); Thomas S. Huda, New Middletown, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/708,447

(22) Filed: Feb. 20, 2007

(51) Int. Cl.
*H01R 29/00* (2006.01)

(52) U.S. Cl. ..... 439/188

(58) Field of Classification Search ..... 439/188, 439/746, 747, 514, 488–490; 200/51.1, 51.12, 200/51.09

See application file for complete search history.

(56) References Cited

U.S. PATENT DOCUMENTS

| | | | | |
|---|---|---|---|---|
| 4,906,203 | A | 3/1990 | Margrave et al. | |
| 5,529,507 | A | 6/1996 | Felix et al. | |
| 5,571,030 | A | 11/1996 | Gladd et al. | |
| 5,733,135 | A | 3/1998 | Kennedy et al. | |
| 5,788,520 | A * | 8/1998 | Roche | 439/188 |
| 5,944,547 | A * | 8/1999 | Golab et al. | 439/188 |
| 6,257,910 | B1 | 7/2001 | Mramor | |
| 6,315,588 | B1 | 11/2001 | Heberlein et al. | |
| 6,431,895 | B1 | 8/2002 | Hung | |
| 2004/0229487 | A1 * | 11/2004 | Lutsch et al. | 439/188 |

* cited by examiner

*Primary Examiner*—Edwin A. León
(74) *Attorney, Agent, or Firm*—David P. Wood

(57) ABSTRACT

An electrical connector (12) has a body (20) with a shorting clip (26) mounted at a distal end (24) of the body (20). The clip (26) axially extends into a cavity (22) of the body and normally shorts two electrical male terminals (25) housed within the body (20).

12 Claims, 5 Drawing Sheets

ENHANCED SHORTING CLIP

TECHNICAL FIELD

This invention relates generally to the electrical connectors and more particularly to a shorting clip for an electrical connector.

BACKGROUND OF THE INVENTION

Female electrical connectors commonly have a shorting clip in the form of a U-shaped body having two depending legs to engage the sides of the respective female terminals. When the male connector is plugged in, the male connector has an abutting surface that engages a ramp on the U-shaped body to deflect it away from the female terminals.

The known designs for shorting clips may be very sensitive to the overall tolerance stack of the connection system. Some designs, particularly ones with lift ramps, are also sensitive to the amount of axial movement of the electrical plugs. Some lift ramps do not always guarantee sufficient deflection to assure disengagement from the female electrical terminals.

Some clips may be overstressed when deflected to introduce permanent yielding that may result in, when released from the deflective force, loss of resilient motion back toward the electrical terminals with a resultant lack of adequate shorting contact force with the electrical terminals.

Shorting clip designs have required mounting of the clip axially within the electrical terminal body which requires specialized assembly steps often with specialized assembly tooling.

SUMMARY OF THE INVENTION

In accordance with one aspect of the invention, an electrical connector assembly has a first connector body with an open ended cavity. Laterally spaced terminals that are made from electrically conductive material are mounted in the terminal cavity. A shorting clip is mounted at a distal end of the first connector body and extends into the terminal cavity. The clip is made from electrically conductive and resiliently yieldable material. The shorting clip has an intermediate deflection section spaced away from a wall of the first connector body and positioned to be deflected a predetermined distance by a second connector body mating with the first connector body. The shorting clip has distal contact areas for normally being biased to abut against both laterally spaced terminals. The distal contact areas are resiliently movable away from the laterally spaced terminals when the intermediate deflection section is deflected by the second connector body.

Preferably, the shorting clip has a laterally extending tab. The first connector body has a side wall with a groove for slidably receiving the tab. The groove has an inclined upper wall for deflecting the shorting clip downward as it is installed into the terminal cavity. The groove ends in a transversely extending notch to allow the tab to move into the notch and allow the shorting clip to resiliently bias to a shorting position against the terminals when fully installed in the first connector body. The tab and notch normally affix the shorting clip axially in place in the first connector body.

Desirably, a secondary lock has a staging position to maintain the shorting clip in a deflected position and to provide space between the secondary lock and distal contact areas in order to install the laterally spaced terminals into the terminal cavity without abutting or touching the shorting clip. The secondary lock is movable from the staging position to a seat position to allow the shorting chip to resiliently bias to its shorting position against the terminals.

In one embodiment, the secondary lock has laterally movable between the staging position to the seat position. The secondary lock has notches therein to receive a portion of the shorting clip as it resiliently moves to its shorting position. The shorting clip has a raised standoff area to abut the secondary lock when in the staging position to space the distal contact area from the terminals and receivable in the notches of the secondary lock when in the seat position to allow the distal contact area to abut the terminals.

In one embodiment, the terminals are male terminals extending axially within the terminal cavity. In one embodiment, the groove has a lower abutment wall for preventing the shorting clip from overdeflecting.

DETAILED DESCRIPTION OF THE PREFERRED EMBODIMENTS

Figure 1:
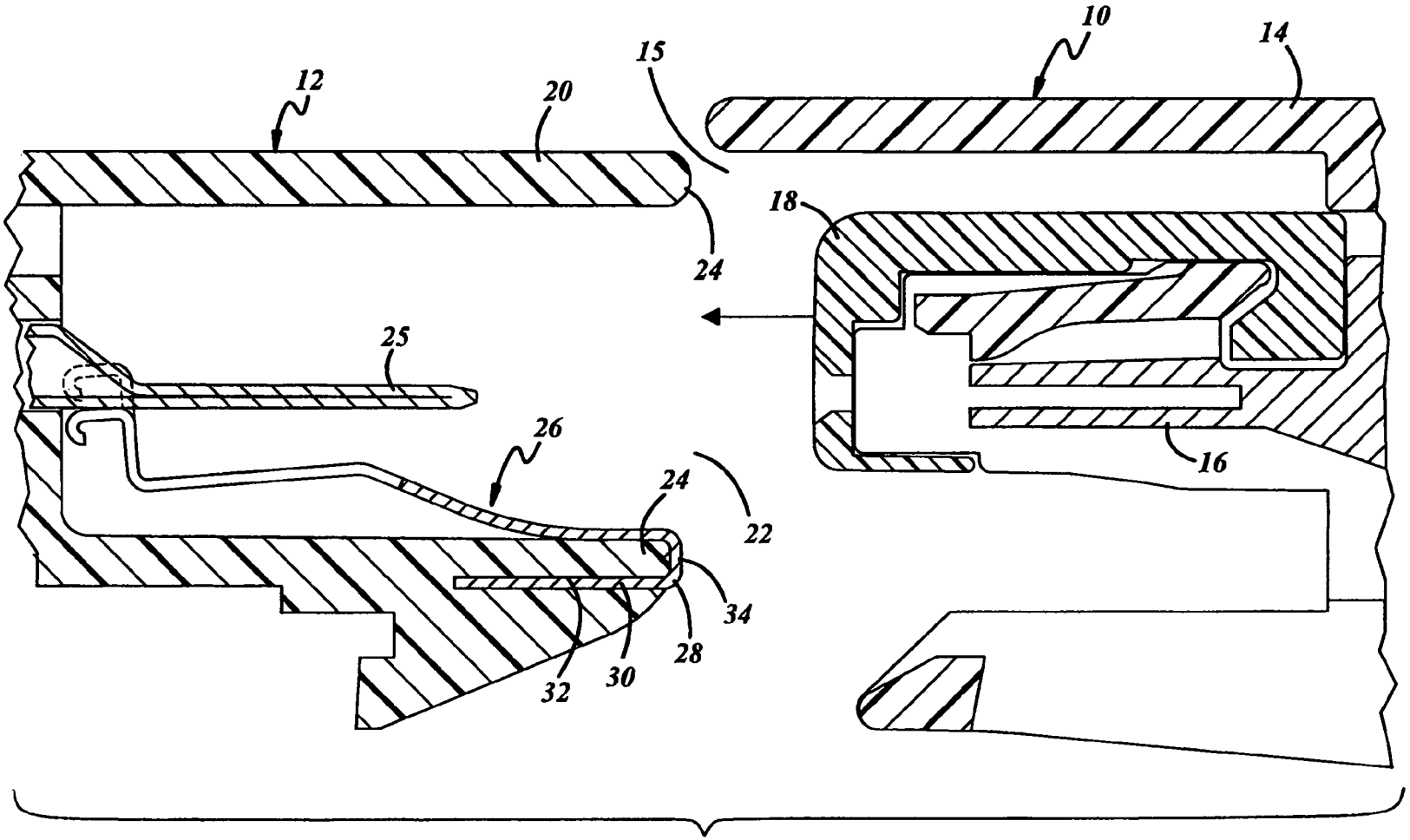
FIG. 1 is a segmented elevational view of complementary male and female electrical connectors with the male electrical connector incorporating a shorting clip.
Figure 2:
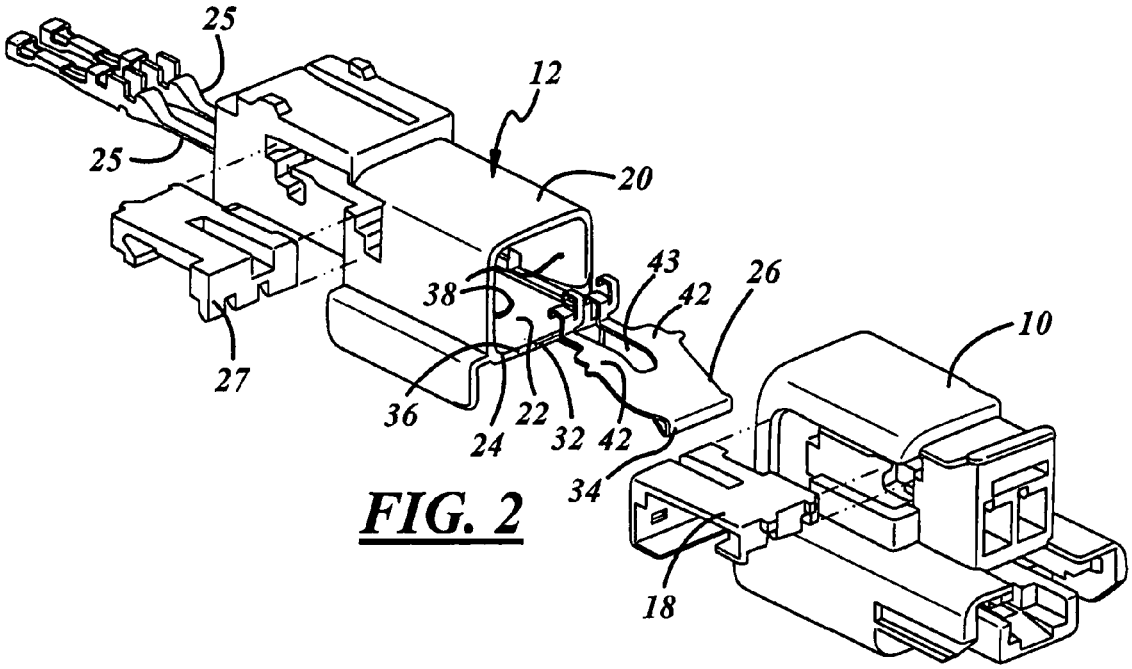
FIG. 2 is a perspective exploded view of the electrical connectors shown in FIG. 1.

Referring now to the drawings and more particularly to FIGS. 1-2, a mateable electrical female and male connectors 10 and 12 are shown in an uncoupled or disengaged relation.

The electrical female connector 10 comprises a body 14 with an axial opening 15 that also has two female terminals 16 mounted therein. The terminals 16 are installed and locked in place by a slide lock 18.

Figure 3:
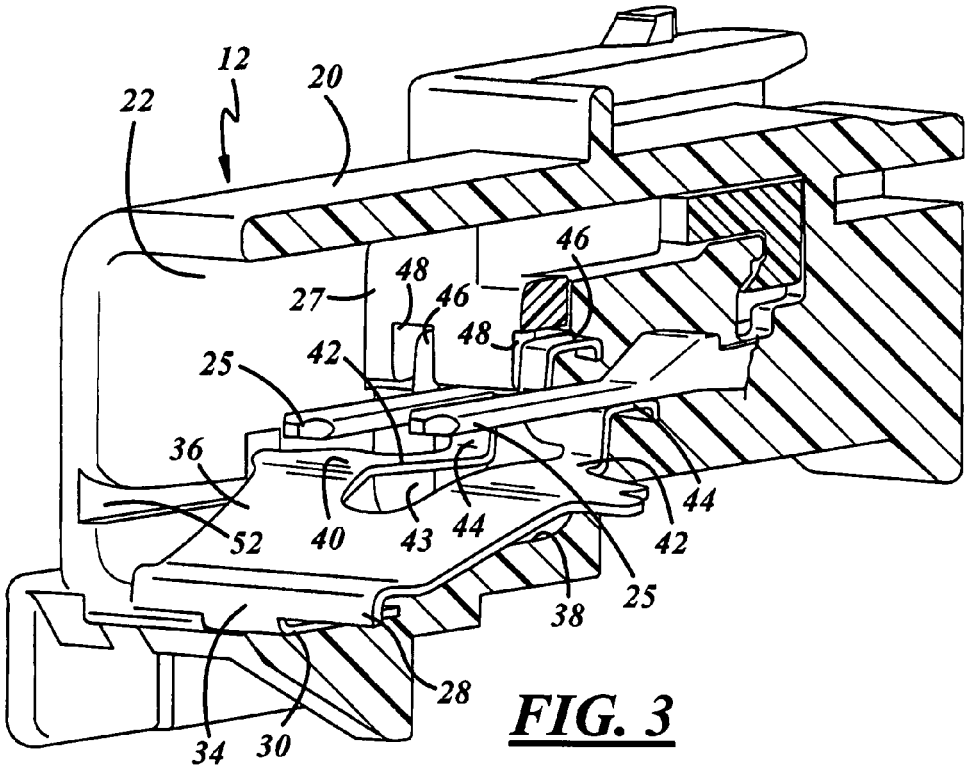
FIG. 3 is a fragmentary perspective and segmented view of the male electrical connector shown in FIG. 1.

The male connector 12 has a body 20 also with an axial extending cavity 22 extending from a distal end 24 thereof that houses two laterally spaced electrical male terminals 25 made from electrically conductive material e.g. metal. A shorting clip 26 is affixed near or at the distal end 24 and extends into the axial opening 22 to abut the two laterally spaced terminals. The shorting clip 26 is also made from electrically conductive and resiliently yieldable material e.g. spring steel, to short the two laterally spaced male terminals 25 together when the female connector is not engaged as shown in FIGS. 1 and 3. A secondary lock 27 is also used to expedite installation of the shorting clip 26 and terminals 25.

Figure 6:
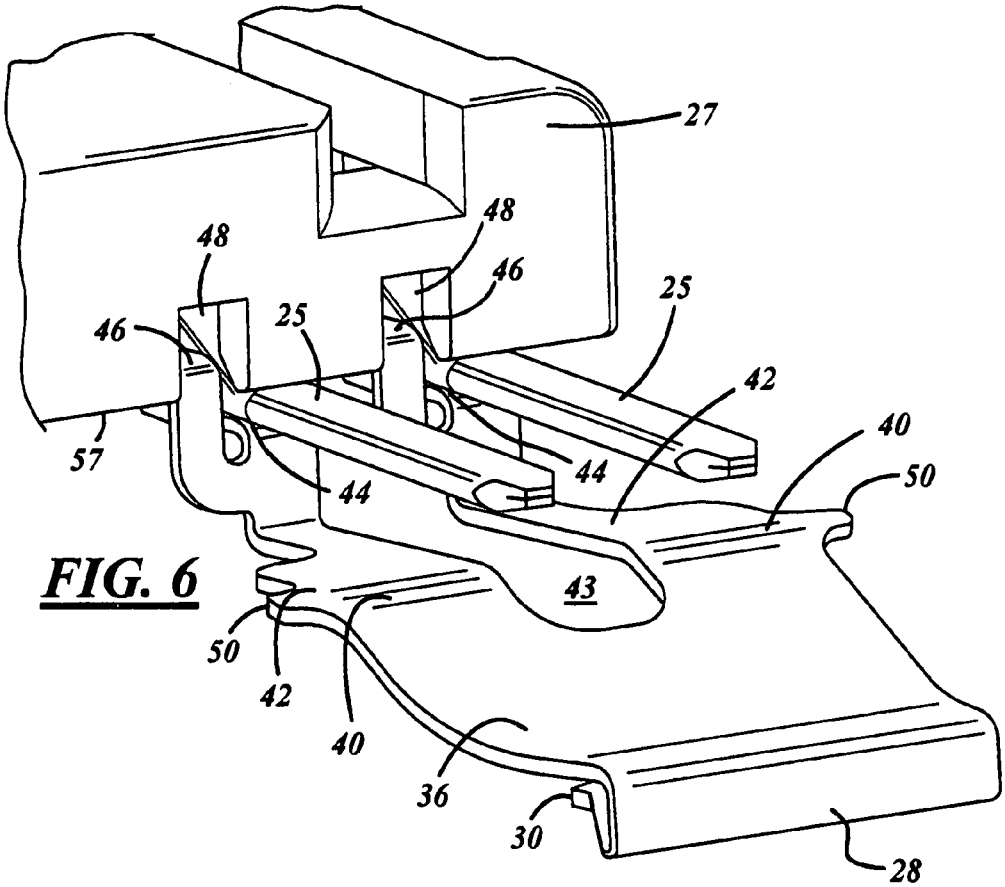
FIG. 6 is a view similar to FIG. 5 illustrating the secondary lock in the seat position.

The shorting clip has a mounting section 28 that comprises a lower plate 30 that fits in a slot 32 of the male connector body 20 at the distal end 24. The shorting clip then has a nose section 34 that wraps about a lip 36 of the body at the distal end 24. The clip 26 then doubles back to extend within the axial opening 22 and has an inclined section 36 that slopes up and away from the inner walls 38 of the body about the axial opening 22 and then levels off at a deflection section 40. The shorting clip then forks into two prongs 42 which are laterally spaced to provide a central gap 43 therebetween. Each prong 42 which have two vertical standoff sections 44 and 46. Vertical standoff section 44 is set lower than standoff section 46 and is laterally spaced therefrom. The shorting clip 26 is normally resiliently biased such that each standoff section 44 normally constants a respective male terminal 25 to short the terminals 25. When in this shorting position, each standoff section 46 is laterally positioned to fit within a respective notch 48 in the secondary lock 27 as shown in FIGS. 1 and 6.

Figure 4:
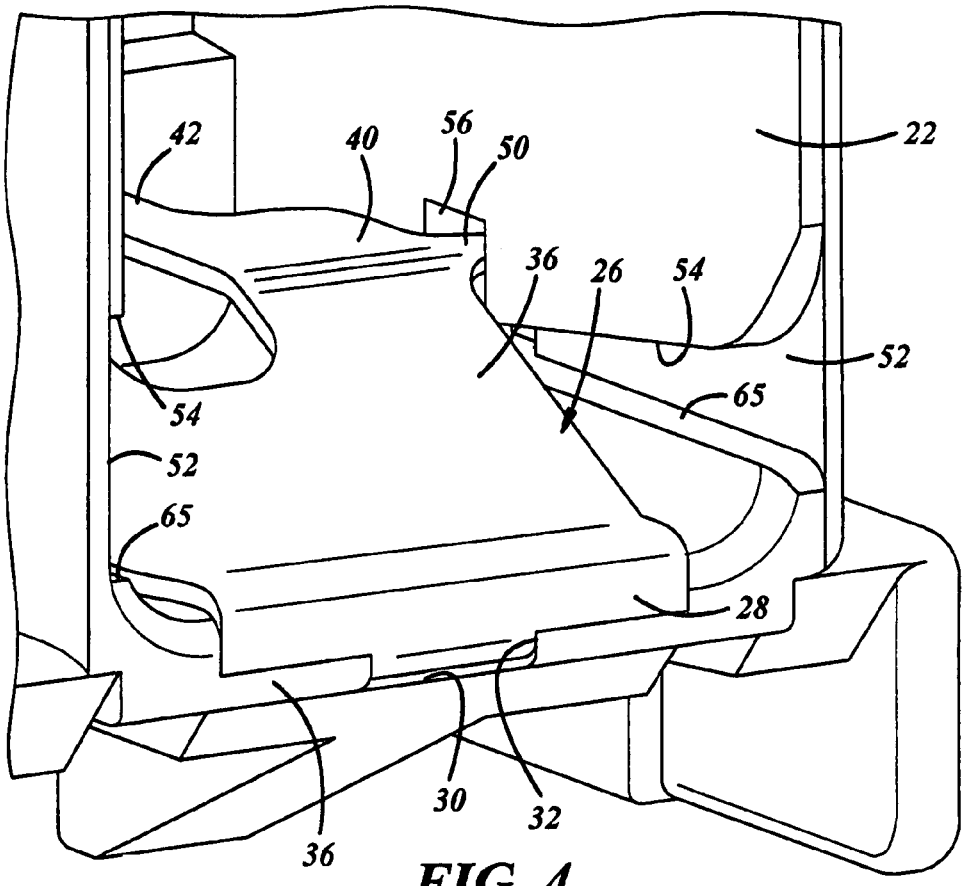
FIG. 4 is an enlarged perspective view illustrating the deflecting groove and notch and tab interconnection between the shorting clip and male connector housing.

Referring now to FIG. 4, installation of the shorting clip 26 is commenced by just placing the mounting plate 30 in the slot and pushing in the clip 26 into the slot 32. As the plate 30 slides in slot 32, the rest of clip 26 is slid into the cavity 22 it has a side locking tab 50 that engages a side groove 52 in opposing walls 38. The upper shoulder 54 of the groove biases the tab 50 downward as the tab progresses inward along groove 52. The clip 26 when fully inserted has the tab aligned with a notch or window 56 that transversely extends from groove 52 to allow the clip to bias upward as shown in the drawings.

Figure 5:
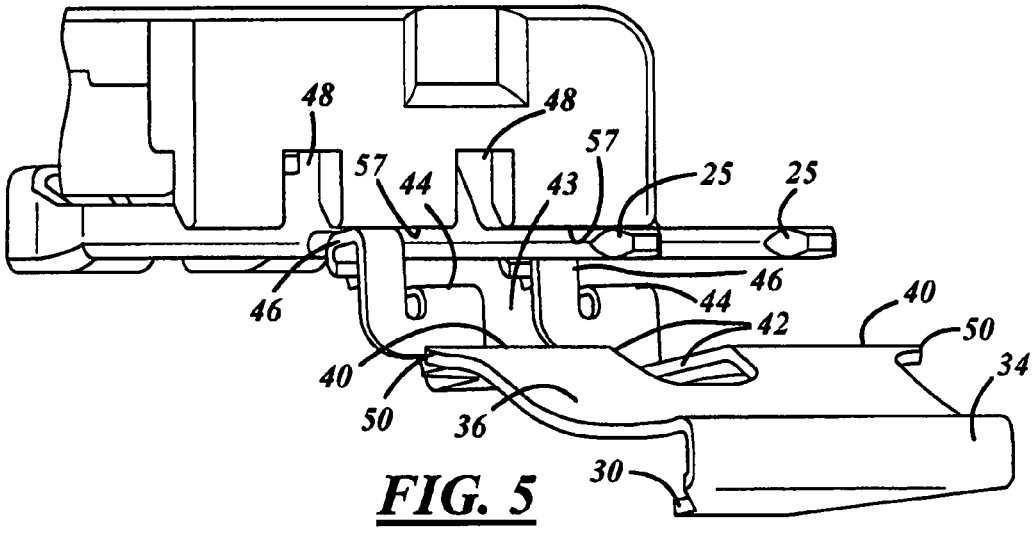
FIG. 5 is a schematic perspective view illustrating the secondary lock in the stage position.
Figure 7:
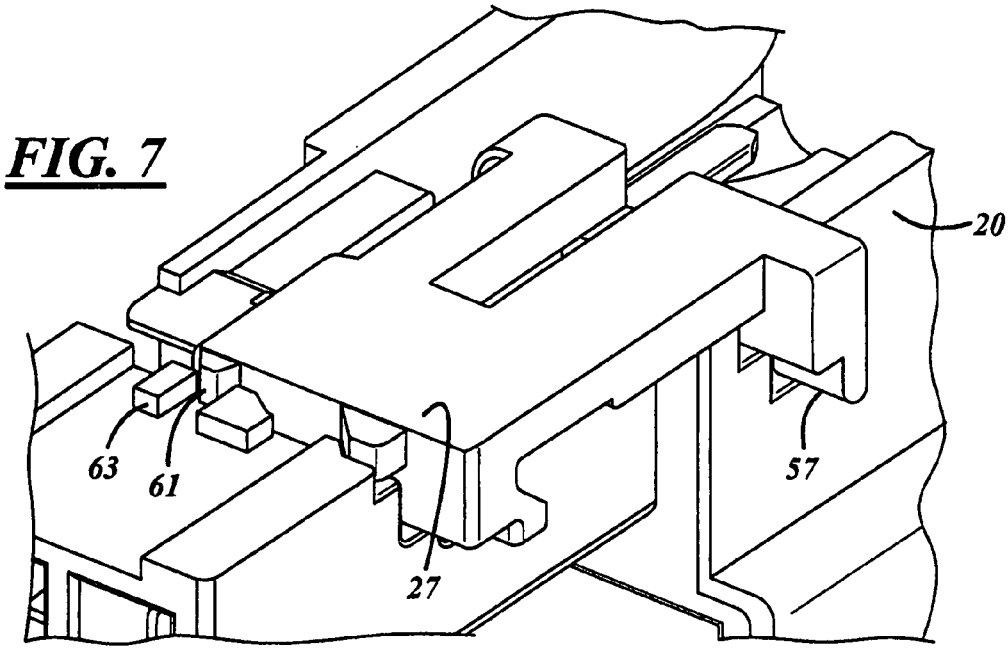
FIG. 7 is a top perspective view showing the secondary lock and it's staged position with the electrical connector housing.
Figure 8:
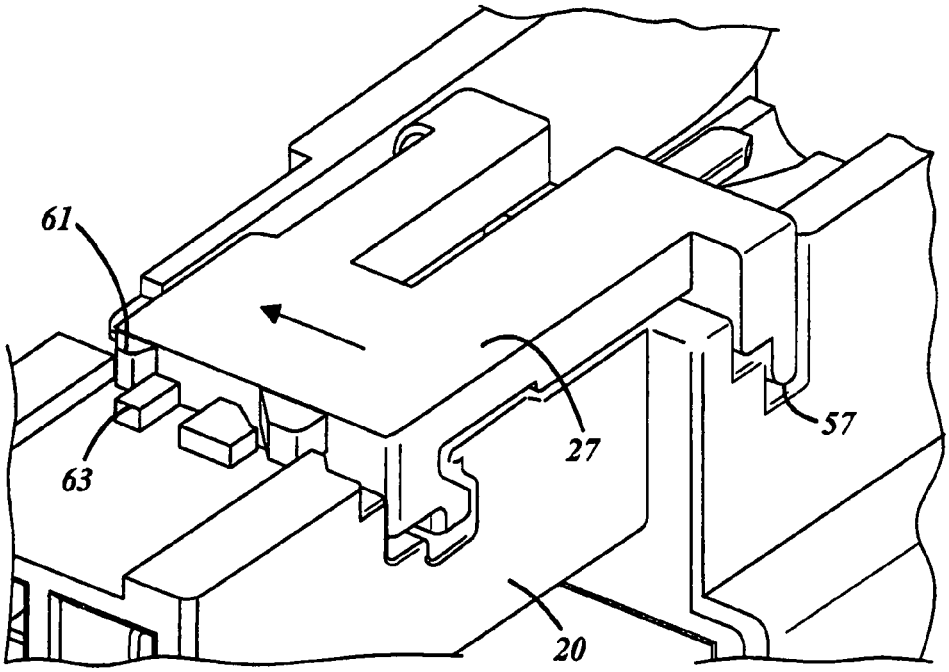
FIG. 8 is a top perspective view similar to FIG. 7 showing the secondary lock in its seated and locked position with the electrical connector housing.

Referring now to FIG. 5, the shorting clip in this stage of installation now has standoffs 46 tucked under and abut a lower edge 57 of secondary slide lock 27. Thus the vertical standoffs 44 are sufficiently spaced away from the lower edge 57 of lock 27 to allow the male terminals 25 to be installed from the back side of the body as shown in FIG. 2 without interference from the standoffs 44. After the male terminals are installed, the slide lock 27 is moved from the staged position as shown in FIGS. 5 and 7, to the seated and locked position as shown in FIGS. 6 and 8. Complementary and engaging locking tabs 61 and 63 prevent unintentional movement out of the seating position. When the secondary slide lock 27 is moved to the seated and locked position, the notches 48 become aligned with the standoffs 46. At this time the resilient bias of the shorting clip 26 allows the standoffs 46 to rise into the notches 48 as shown in FIG. 6 and the lock tabs 50 rise into the side notch 56 as shown in FIG. 4. The shorting clip 26 is now fully installed into the male connector body 20. The tabs 50 interaction with the notches 56 locks the clip within the body to prevent unintentional disengagement of the shorting clip 26.

Figure 9:
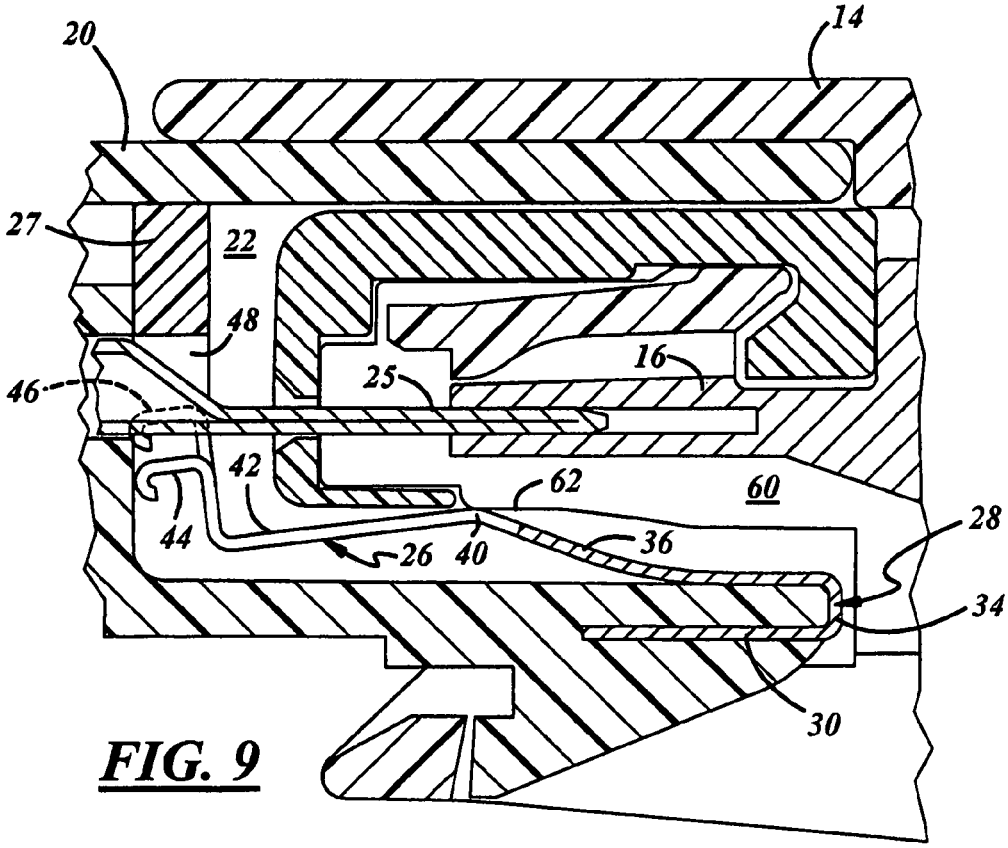
FIG. 9 is the view a similar to FIG. 1 illustrating the two electrical connectors plugged in together with the shorting clip deflected downward and disengaged from the electrical terminals.

The male connector 12 is now ready to be mated to the female connector 14. As shown in FIG. 9, when the female connector body 14 has an engaging section 60 intruding into axial opening 22 and has a straight abutment surface 62 abuts against and deflects the deflection section 40 downward as shown in the drawing. Because the deflection section 40 is an intermediate section interposed between the mounting second and the distal standoffs 44, the entire clip deflection appears to be a pivot about the mounting section. As such the deflection of the distal standoffs 44 will be magnified substantially more that of the amount of deflection of deflection section 40.

Once the female connector is engaged past the deflection area 40 (to the right as shown in FIGS. 1 and 9), the shorting clip 26 is fully disengaged from the male terminals 25. Further intrusion by the female connector 10 has no further deflection effect on the shorting clip 26. In other words, the shorting clip is tolerant of the axial position of the female body 10 once it is engaged past deflection section 40.

Once the female body, becomes disengaged past the deflection section 40 (to the left as shown in FIGS. 1 and 9), the shorting clip 26 resiliently biases back to the position shown in FIG. 1 and has standoff section 44 contact each male terminal 25 to provide the desired short between the terminals 25.

If the shorting clip needs to be removed from the body 20, it is deflected downward till tab 50 moves out of notch 56 till it engages the lower wall 65 of groove 52 which aligns the tab 50 with groove 52 and frees the clip to be pulled out with tab 50 sliding in groove 52. The lower wall 65 is positioned to prevent the clip 26 from over-deflecting by abutting the tab 50.

In this fashion, by having the shorting clip 26 mounted at the male connector body 20 in the preferred embodiment, lift ramps found in previous constructed shorting clips have been eliminated and the concerns regrading potential breakage or creep of the lift ramp have also thus been eliminated. The basic clip geometry provides increased deflection movement of the standoff section 44 compared to the deflection travel of the mid area—i.e. the deflection area 40 and thus the issue of low deflection movement that has been a concern with other designs has been eliminated. While past clips have been critically sensitive of the axial position of one body with respect to a lift ramp, the present construction eliminates this critical sensitivity. The present construction is not sensitive to the position along the axis of engagement of the female body beyond the deflection area 40.

The present construction of the lip also provides for installation with basic tooling. The mount second at the distal end eliminates the need for specialized tooling that needs to intrude deep into the axial cavity to install the clip. The clip is installed with a sliding motion until the tab locks into the side notch to lock the clip in place. Any over-deflection concerns relation to over deflection during installation have been eliminated. The secondary lock also provides installation of the terminals without the need of specialized tooling. Again, concerns about over-deflecting the clip during terminal installation have also been eliminated. Because there is no over-deflection engagement and disengagement of the female body, the shorting clip provides for a durable and long lasting life for the electrical terminal body.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arraignments, the present invention being limited only by the following claims and the equivalents thereof.

We claim:

1. An electrical connector assembly comprising:

a first connector body having an open ended cavity;

laterally spaced terminals that are made from electrically conductive material being mounted in said terminal cavity;

a shorting clip being mounted at a distal end of said first connector body and extending into said terminal cavity;

said shorting clip being made from electrically conductive and resiliently yieldable material;

said shorting clip having an intermediate deflection section spaced away from a wall of said first connector body and positioned to be deflected a predetermined distance by a second connector body mating with said first connector body; and said shorting clip having distal contact areas for normally being biased to abut against the laterally spaced terminals and resiliently movable away from said laterally spaced terminals when said intermediate deflection section is deflected by said second connector body;

further comprising a secondary lock having a first staging position to maintain the shorting clip in a deflected position to provide space between the secondary lock and distal contact areas in order to install the laterally spaced terminals into said terminal cavity without abutting or touching the shorting clip.

2. An electrical connector assembly as defined in claim 1 further comprising:

said terminals being male terminals extending axially through said terminal cavity.

3. An electrical connector assembly as defined in claim 1 further comprising:

said shorting clip having a laterally extending tab;

said first connector body having a side wall with a groove therein receiving the tab;

the groove having an inclined upper wall for deflecting said shorting clip against its bias as it is installed into said terminal cavity; and said deflector groove ending in a transversely extending notch to allow said tab to move into said notch and allow said shorting clip to resiliently bias to a shorting position against said terminals when fully installed in said first connector body; and said tab and notch normally affixing said shorting clip axially in place in said first connector body.

4. An electrical connector assembly as defined in claim 3 further comprising:

said groove having a lower abutment wall for preventing said shorting clip from overdeflecting by abutting against said tab.

5. An electrical connector assembly as defined in claim 3 said secondary lock being movable from the staging position to a seat position to allow said shorting clip to resiliently bias to its shorting position against said terminal.

6. An electrical connector assembly as defined in claim 5 further comprising:

said secondary lock being laterally movable between the staging position to the seat position; and said secondary lock having notches therein to receive a portion of said shorting clip as it resilatiney moves to its shorting position.

7. An electrical connector assembly as defined in claim 6 further comprising:

said shorting clip having a raised standoff area to abut the secondary lock when in the staging position to space the distal contact area from the terminals; and said raised standoff area being receivable in the notches of the secondary lock when in the seat position to allow the distal contact area to about the terminals.

8. An electrical connector assembly as defined in claim 7 further comprising:

said terminals being male terminals extending axially within the terminal cavity.

9. An electrical connector assembly as defined in claim 8 further comprising:

said groove having a lower abutment wall for preventing said shorting clip from overdelecting by abutting against said tab.

10. An electrical connector assembly as defined in claim 1 said secondary lock being movable from the staging position to a seat position to allow said clip to resiliently bias to its shorting position against said terminals.

11. An electrical connector assembly as defined in claim 10 further comprising:

said secondary lock being laterally movable between the staging position to the seat position; and said secondary lock having notches therein to receive a portion of said shorting clip as it resiliently moves to its shorting position.

12. An electrical connector assembly as defined in claim 11 further comprising:

said shorting clip having a raised standoff area to abut the secondary lock when in the staging position to space the distal contact are from the terminals; and said raised standoff area being receivable in the notches of the secondary lock when in the seat position to allow the distal contact area to abut the terminals.

* * * * *